US005513417A

United States Patent [19]

Kim et al.

[11] Patent Number: 5,513,417

[45] Date of Patent: May 7, 1996

[54] SILENCING DEVICE FOR VACUUM CLEANER

[75] Inventors: Tae-Sig Kim; Jong-Su Choi, both of Suwon, Rep. of Korea

[73] Assignee: Samsung Electronics Co., Ltd., Suwon, Rep. of Korea

[21] Appl. No.: 274,791

[22] Filed: Jul. 14, 1994

[30] Foreign Application Priority Data

Jul. 19, 1993 [KR] Rep. of Korea ..... 1993-13328
Aug. 26, 1993 [KR] Rep. of Korea ..... 1993-16656

[51] Int. Cl.[6] ..... A47L 9/22

[52] U.S. Cl. ..... 15/326; 15/412; 181/202; 55/276

[58] Field of Search ..... 181/231, 207, 181/205, 202; 15/326, 412; 55/276

[56] References Cited

U.S. PATENT DOCUMENTS 4,864,683 9/1989 Herron, Jr. et al. ..... 15/326 X
4,970,753 11/1990 Herron, Jr. ..... 15/326
5,293,664 3/1994 Lim et al. ..... 15/326

FOREIGN PATENT DOCUMENTS 62-45631 7/1987 Japan .

*Primary Examiner*—Khanh Dang
*Attorney, Agent, or Firm*—Burns, Doane, Swecker & Mathis

[57] ABSTRACT

A silencing device for a vacuum cleaner includes dampers for absorbing operational vibration of a suction motor. The operational noises of the suction motor are intercepted and suppressed by a middle case, a lower case, a bottom case and a top case. The exhaust noises caused by exhaust air flow are repeatedly absorbed and suppressed by a plurality of exhaust ports. The exhaust air flow is also dispersed so as to suppress the exhaust noises. In the primary embodiment, the noises generated by both the suction motor and the exhaust air flow are effectively suppressed to desired low levels. In a second embodiment, the silencing device comprises a noise absorber for absorbing and suppressing both suction noises caused by suction air flow and operational noises of the suction motor. The silencing device also has a cover for covering and supporting the front surface of the noise absorber. The back of the noise absorber is supported by a rear supporter. In the second embodiment, the noises generated by both the suction motor and the suction air flow during suction of dirt-laden air by the suction motor are effectively suppressed to desired low levels.

10 Claims, 9 Drawing Sheets

SILENCING DEVICE FOR VACUUM CLEANER

BACKGROUND OF THE INVENTION

1. Field of the Invention

The present invention relates in general to a silencing device of a vacuum cleaner for effectively suppressing noises of the vacuum cleaner such as caused by a suction motor, suction air flow and exhaust air flow and, more particularly, to an improved structure in such a silencing device of the vacuum cleaner for improving the noise suppressing effect.

2. Description of the Prior Art

In the prior art, there have been proposed and widely used several types of silencing devices for vacuum cleaners.

For example, Japanese U.M. Publication No. Sho. 62-45631 (applied on Oct. 23, 1981 and published on Dec. 7, 1987) discloses a silencing device for a vacuum cleaner which is shown in FIG. 1 of the accompanying drawings.

As shown in FIG. 1, the conventional vacuum cleaner comprises a suction motor 2' provided in a cleaner casing 1'. In FIG. 1, the exhaust port provided on the back of the casing 1' for exhausting the purified air to the outside is designated by the numeral 3'. The suction motor 2' for generating suction force communicates with the exhaust port 3' through both an air path 4' and an exhaust silencer 5'. The exhaust silencer 5' defines an exhaust path 6' therein. In the above silencing device, the exhaust path 6' of the exhaust silencer 5' is inclined upwardly from the air path 4' at an obtuse angle. With the inclined relationship between the exhaust path 6' and the air path 4' of the casing 1', it is possible to suppress the turbulence noise caused by the exhaust air flow having already passed the suction motor 2'. In the above silencing device, the turbulence noise is partly absorbed and suppressed by a noise absorbing material 7'.

However, the above silencing device for a vacuum cleaner, while partly absorbing and suppressing the exhaust noise caused by the exhaust air flow having passed the suction motor 2', nevertheless has a problem that the exhaust air flow should pass through a relatively short path and be exhausted to the outside of the casing 1' from only one exhaust port 3' of the casing 1', so that it is impossible to achieve the desired noise absorbing and suppressing effect.

The conventional silencing device has no means for suppressing the suction noise caused by the suction motor 2' so that the suction noise travels to the outside of the casing 1'. Furthermore, the conventional silencing device cannot effectively absorb and suppress the noise caused by the exhaust air flow of the suction motor 2'. In this regard, a vacuum cleaner equipped with the above silencing device cannot prevent the emission of excessive noise to the outside during its operation.

In addition, the conventional silencing device cannot suppress the noise caused by the suction air flow generated in the dirt collection chamber of the cleaner when the cleaner sucks dirt-laden air. The vacuum cleaner equipped with the above silencing device thus emits the excessive noise to the outside during its operation and this is not only annoying to the user, but also deteriorates the quality of the vacuum cleaner.

SUMMARY OF THE INVENTION

It is, therefore, an object of the present invention to provide a silencing device for a vacuum cleaner in which the aforementioned problems can be overcome and which more effectively absorbs and suppresses the noises of the cleaner, such as caused by the suction motor, exhaust air flow and suction air flow of the cleaner, thereby not only giving pleasure to the user but also improving the quality of the cleaner.

In an embodiment, the above object is accomplished by a silencing device for a vacuum cleaner comprising: damping means for absorbing operational vibration of a suction motor of the cleaner; means for intercepting operational noises generated by the suction motor; means for absorbing and suppressing exhaust noises caused by an exhaust air flow having already passed through the suction motor; and means for dispersing the exhaust air flow.

In accordance with the silencing device of the above embodiment, the noises generated by both the suction motor and the exhaust air flow are effectively suppressed to desired low levels, thus to avoid displeasure to the user and improve the quality of the vacuum cleaner.

In another embodiment, the above object is accomplished by a silencing device for a vacuum cleaner comprising: a noise absorber for absorbing and suppressing both suction noises caused by suction air flow and operational noises of a suction motor of the cleaner; a cover for covering and supporting the front surface of the noise absorber; and a rear supporter placed at the back of the noise absorber so as to support the back of the noise absorber.

In accordance with the silencing device of the another embodiment, the noises generated by both the suction motor and the suction air flow during suction of dirt-laden air by the suction motor are effectively suppressed to desired low levels, thus to cause only a weak noise to be emitted to the outside and, as a result, give pleasure to the user and improve the quality of the vacuum cleaner.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
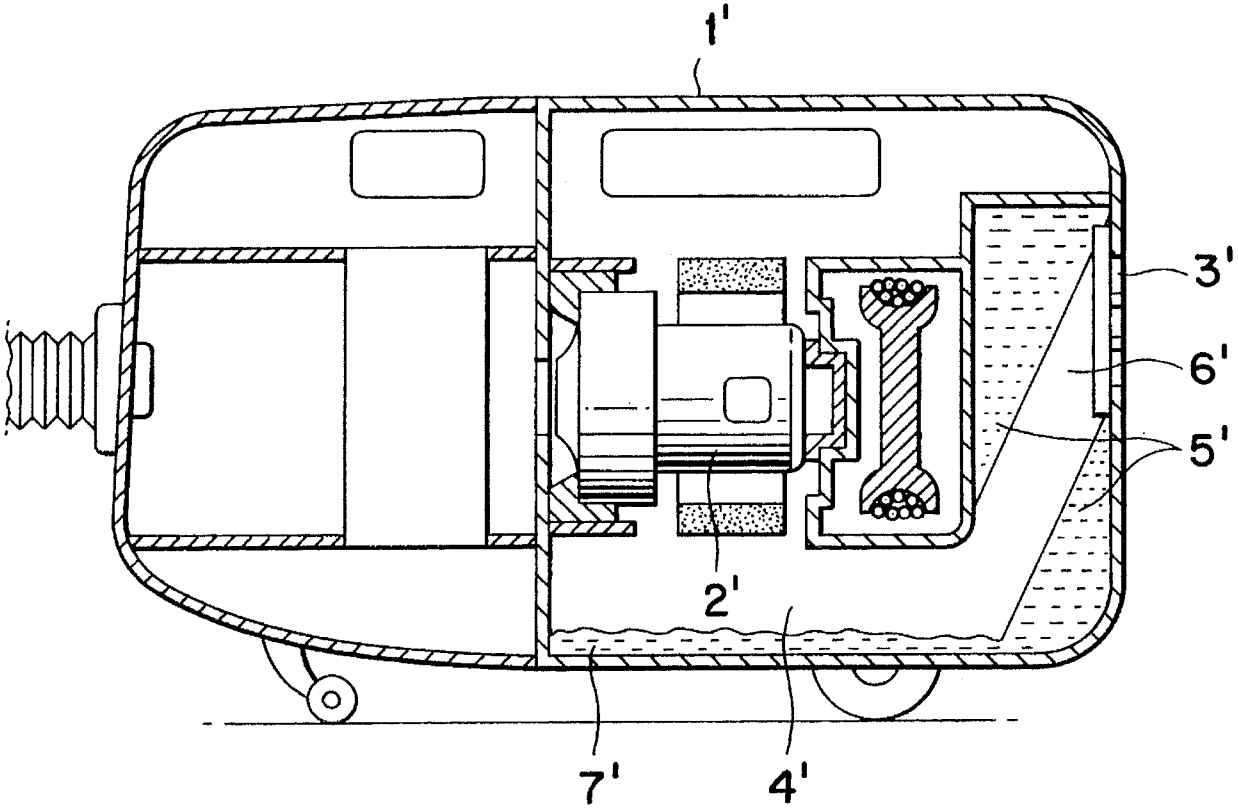
FIG. 1 (PRIOR ART)
FIG. 1 is a schematic sectional view of a vacuum cleaner equipped with a conventional silencing device.
Figure 2:
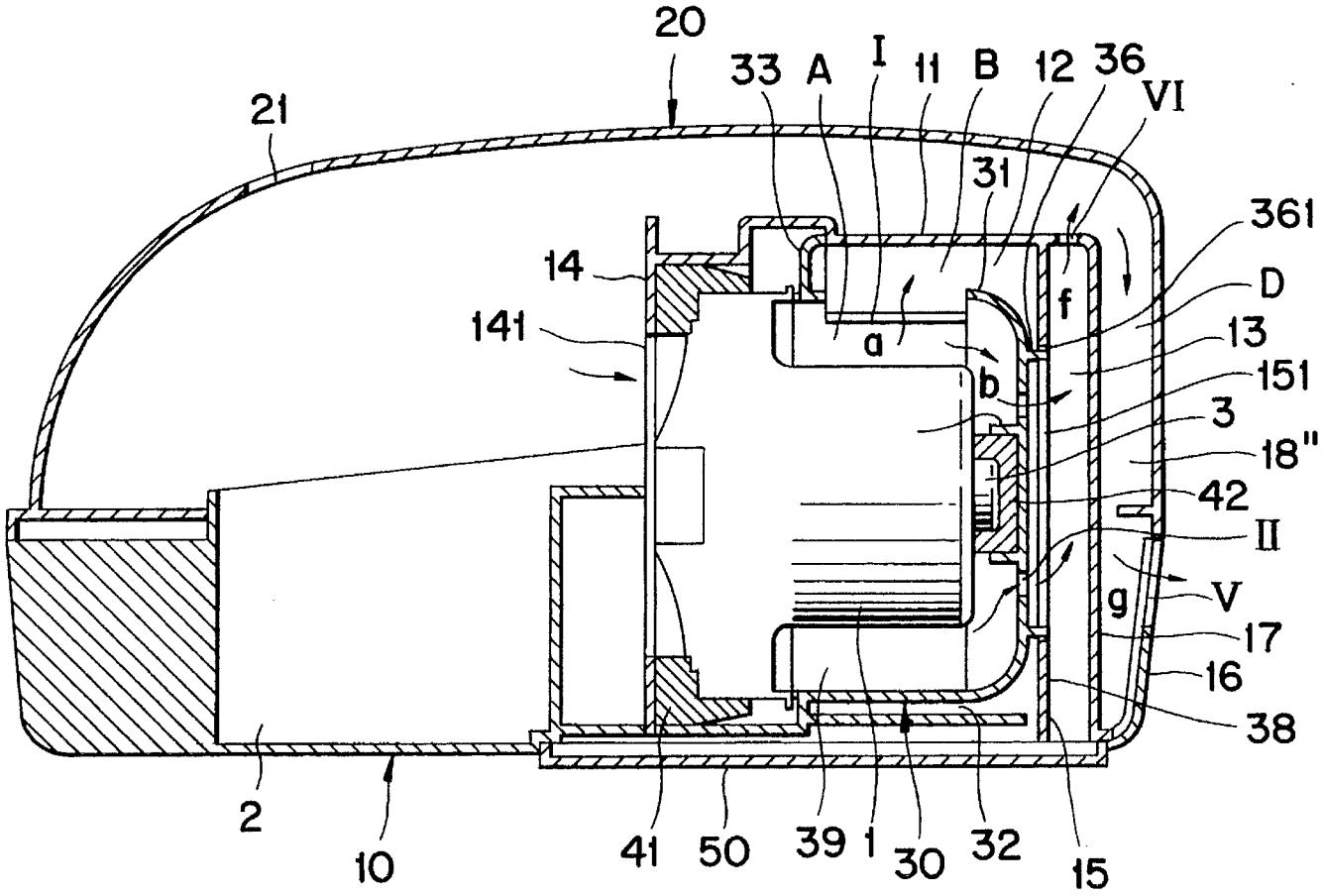
FIG. 2 is a schematic sectional view of a vacuum cleaner having a silencing device of a primary embodiment of the present invention.

With reference to FIGS. 2 to 6, there is shown a silencing device for a vacuum cleaner in accordance with a primary embodiment of the present invention.

In FIGS. 2 to 6, the suction motor for suction of dirt-laden air suction into the cleaner as well as for exhaust of purified air to the outside of the cleaner is designated by the numeral 1. The lower and top cases defining an outer case structure (and thus defining the outer appearance of the cleaner) are designated by the numerals 10 and 20 respectively. The lower case 10 receives a middle case 30 therein.

The lower case 10 also defines therein a dirt collection chamber 2 receiving a dirt collection bag. The middle case 30 is received in a middle case receiving chamber 12 of the lower case 10 and defines a generator chamber for receiving the suction motor 1 of a suction generator. The lower case 10 further includes a noise absorbing chamber 13 (FIG. 4) for absorbing the noise caused by the exhaust air flow having already passed through the suction motor 1. A first cavity 18' is provided in the lower case 10 in order for forming an exhaust path in cooperation with both a bottom case, which will be described later herein, and the middle case 30 for absorbing and suppressing the noise caused by the exhaust air flow. The lower case 10 also includes second and third cavities 18" and 18"". The second and third cavities 18" and 18''' of the lower case 10 cooperate with the top case 20 so as to define exhaust paths and to absorb and suppress the noises caused by the exhaust air flow.

In the lower case 10, the middle case receiving chamber 12 and the dirt collection chamber 2 are separated from each other by a support 14 having a suction port 141. The receiving chamber 12 and the noise absorbing chamber 13 are separated from each other by a partition 15 having an exhaust opening 151. The noise absorbing chamber 13 is also separated from the second cavity 18" by a partition wall 17.

In order to separate the second cavity 18" from the outside, the lower case 10 has a outer casing 16. The first cavity 18' of the lower case 10 is defined by both a cover 11 and rib fixing parts 18. The third cavity 18''' is formed about the dirt collection chamber 2.

The cover 11 is provided with a plurality of exhaust ports VI for exhausting the exhaust air flow having already passed through the noise-absorbing chamber 13. In the same manner, a plurality of additional ports VII are formed on an inside wall 19, the inside wall defining the dirt collection chamber 2.

The lower case 10 also has side exhaust ports VIII on front portions of its opposite sides. The exhaust air is partly discharged to the outside through the side exhaust ports VIII which have respective noise absorbing filters. The exhaust air is also partly discharged to the outside through rear exhaust ports V provided at the back of the lower case 10. In the same manner as described for the side exhaust ports VIII, the rear exhaust ports V have a noise absorbing filter. The ports V and VIII constitute final air discharge ports from which the exhaust air enters the ambient atmosphere.

The suction motor 1 includes damping means for absorbing the vibration generated by the motor 1 and suppressing the vibrating noise.

That is, an annular front damper 41 having a suction port 411 is fitted over the front of the suction motor 1 in such a manner that a surface contact is achieved between the damper 41 and the front of the motor 1. The back of the suction motor 1 is provided with a rear center projection 3. This projection 3 is totally covered by a rear damper 42 in the form of a cap. With the front and rear dampers 41 and 42, the operational vibration of the suction motor 1 is reliably absorbed so that there is no vibrational noise in the suction motor 1 during the operation of the motor 1.

The middle case 30 includes a motor chamber 39, which chamber 39 receives the suction motor 1 therein. The motor chamber 39 not only intercepts the noise of the suction motor 1 but also defines a first exhaust path A for absorbing and reducing the noise caused by the exhaust air flow of the suction motor 1. The middle case 30 further includes a cavity 32 which defines, in cooperation with the lower case 10, a second exhaust path B.

That is, the middle case 30 includes a cover part 31 and a rear part 38 for forming the motor chamber 39 and receives the suction motor 1 in the motor chamber 39. The cavity 32 of the middle case 30 is defined by both the cover part 31 and an outer cover 35 of the middle case 30.

The second exhaust path B, formed between the lower case 10 and the middle case 30 when the middle case 30 is received in the chamber 12 of the lower case 10, should be provided with airtightness. The desired airtightness of the path B is achieved by an airtight flange 33 placed at the front of the cover part 31 of the middle case 30.

A damper support 37 is provided on the inner surface of the rear part 38 of the middle case 30. This support 37 partially receives the rear damper 42 so as to support the damper 42. On the other hand, an annular projection 36 extends from the outer surface of the rear part 38 and is fitted into the exhaust opening 151 of the lower case 10.

In order for provision of the airtightness between the exhaust opening 151 of the lower case 10 and the annular projection 36, an annular packing 361 is interposed between the opening 151 and the annular projection 36.

The outer cover 35 of the middle case 30 includes a pair of ribs 34 on its opposite side ends. The ribs 34 come into surface contact with the rib fixing parts 18 of the lower case 10 and are coupled to the fixing parts 18. The cover part 31, the rear part 38 and the outer cover of the middle case 30 include respective exhaust ports I, II and III for exhausting the air.

The bottom case 50 is mounted on the bottom surface of the lower case 10.

The top case 20 is provided with pipe receiving hole 21 for detachably receiving a suction pipe (not shown).

The aforementioned elements are assembled into the silencing device for the vacuum cleaner as follows. In assembling the elements into the silencing device, the damping means comprising the front and rear dampers 41 and 42 is placed on the suction motor.

That is, the front damper 41 comes into surface contact with the front of the suction motor 1. The front damper 41 is, thereafter, fixed to the front of the motor 1. In the same manner, the rear damper 42 is fixedly to the rear projections 3 of the suction motor 1. The front and rear dampers 41 and 42 absorb the operational vibration of the suction motor 1 and suppress the vibrational noise of the motor 1.

After mounting the front and rear dampers 41 and 42 on opposite ends of the suction motor 1, the motor 1 is received in the motor chamber 39 of the middle case 30. At this time, the rear damper 42 is received in and supported by the damper support 37 of the middle case 30.

As a result of placing of the suction motor 1 in the motor chamber 39 of the middle case 30, the first exhaust path or channel A is formed between the motor 1 and the cover part 31 of the middle case 30. The first exhaust path A guides the exhaust air flow out of the suction motor 1 and, as a result, absorbs and suppresses preliminarily the noise caused by the exhaust air flow.

The middle case 30 is, thereafter, placed in the lower case 10. In placing the middle case 30 in the lower case 10, the front surface of the front damper 41 mounted on the suction motor 1 comes into surface contact with the inner surface of the support 14 of the lower case 10. An edge of the airtight flange 33 of the middle case 30 comes, into surface contact with a corresponding part of the inner surface of the lower case 10 (see FIG. 2). In addition, the annular projection 36 of the middle case 30 is received in the exhaust opening 151 of the lower case 10 with airtight an interposition of the annular packing 361 between them.

As a result of placing of the middle case 30 in the lower case 10, the second exhaust path B or channel is formed between the cover 11 of the lower case 10 and the cover part 31 of the middle case 30. The second exhaust path B will guide the exhaust air flow, which flow has been already guided by the first exhaust path A so as to be preliminarily absorbed and suppressed in its noise. As a result of the second guide of the exhaust air flow by the second path B, the noise of the exhaust air flow is again absorbed and suppressed.

The placing of the middle case 30 as well as the suction motor 1 in the chamber 12 of the lower case 10 is followed by mounting of the bottom case 50 on the bottom surface of the lower case 10.

As a result of mounting of the bottom case 50 on the bottom surface of the lower case 10, a third exhaust path or channel C (see FIG. 6) is formed between the bottom case 50 and the outer cover 35 of the middle case 30. The third path C guides the exhaust air flow, which flow has already passed through the second path B and discharged from the exhaust port III of the outer cover 35 of the middle case 30. As a result of the third guide for the exhaust air flow by the third path C, the noise of the exhaust air flow is absorbed and suppressed once more.

Figure 3:
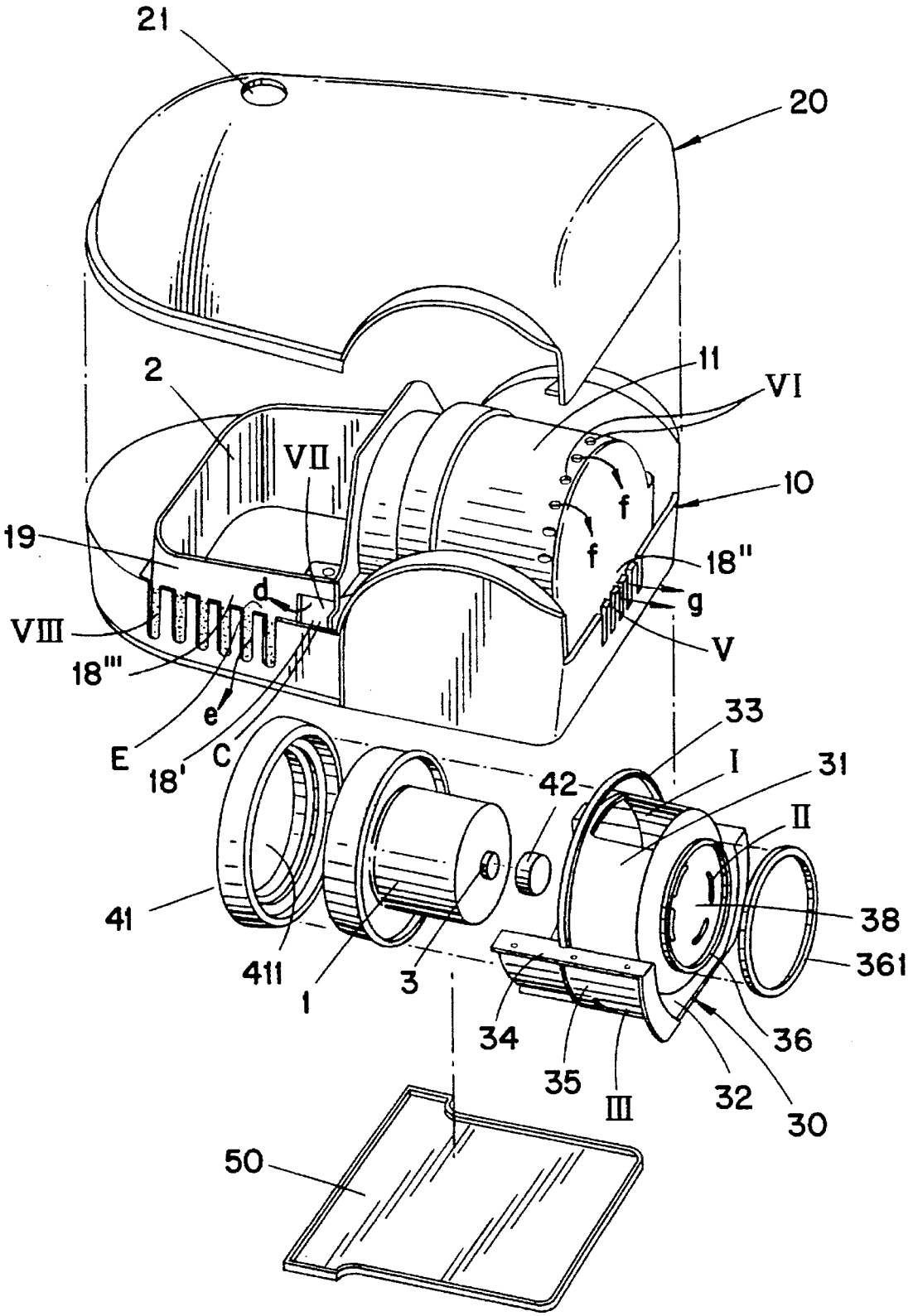
FIG. 3 is an exploded perspective view of the vacuum cleaner of FIG. 2.
Figure 4:
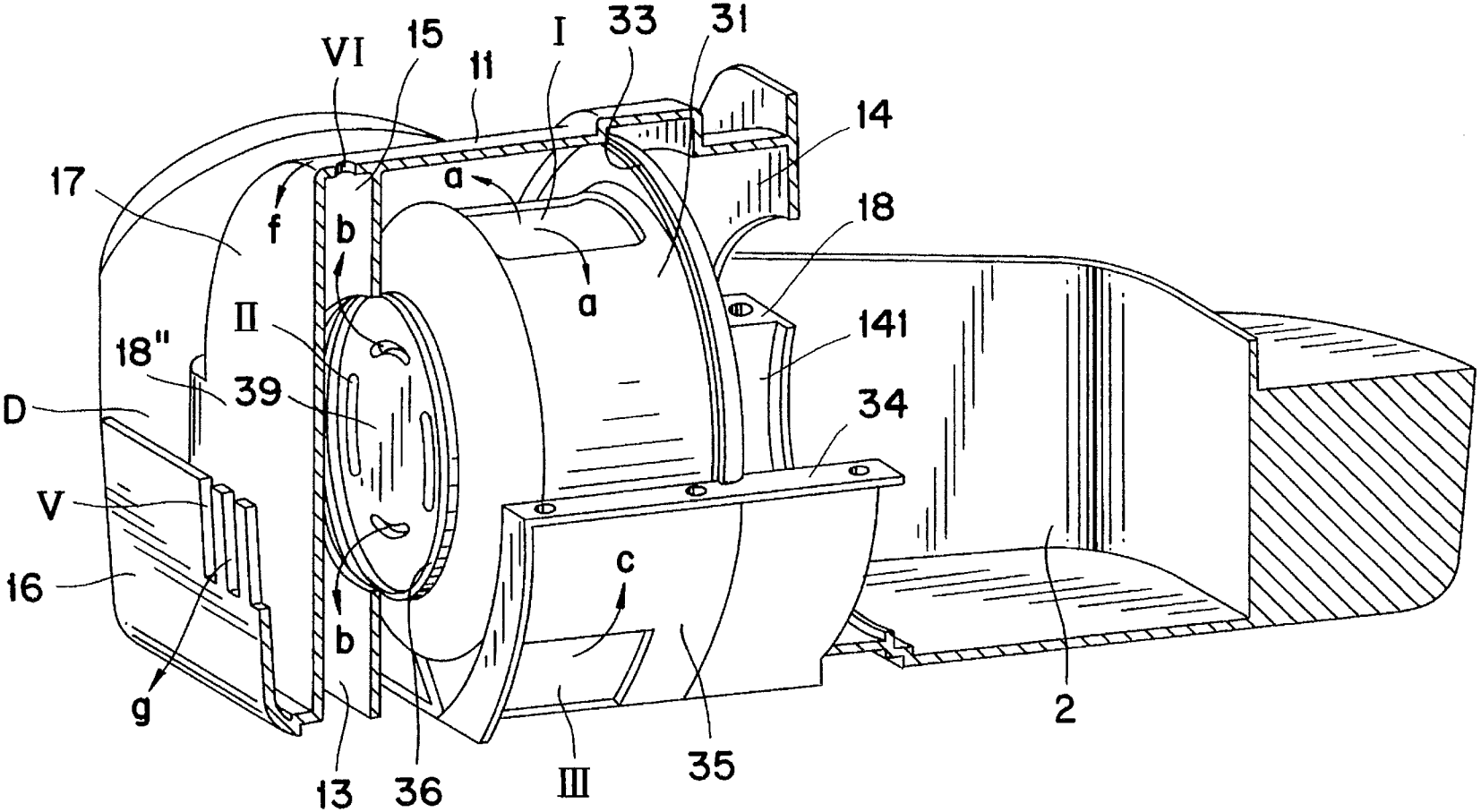
FIG. 4 is a partially broken perspective view of the silencing device according to the primary embodiment having a lower case receiving a middle case therein.
Figure 5:
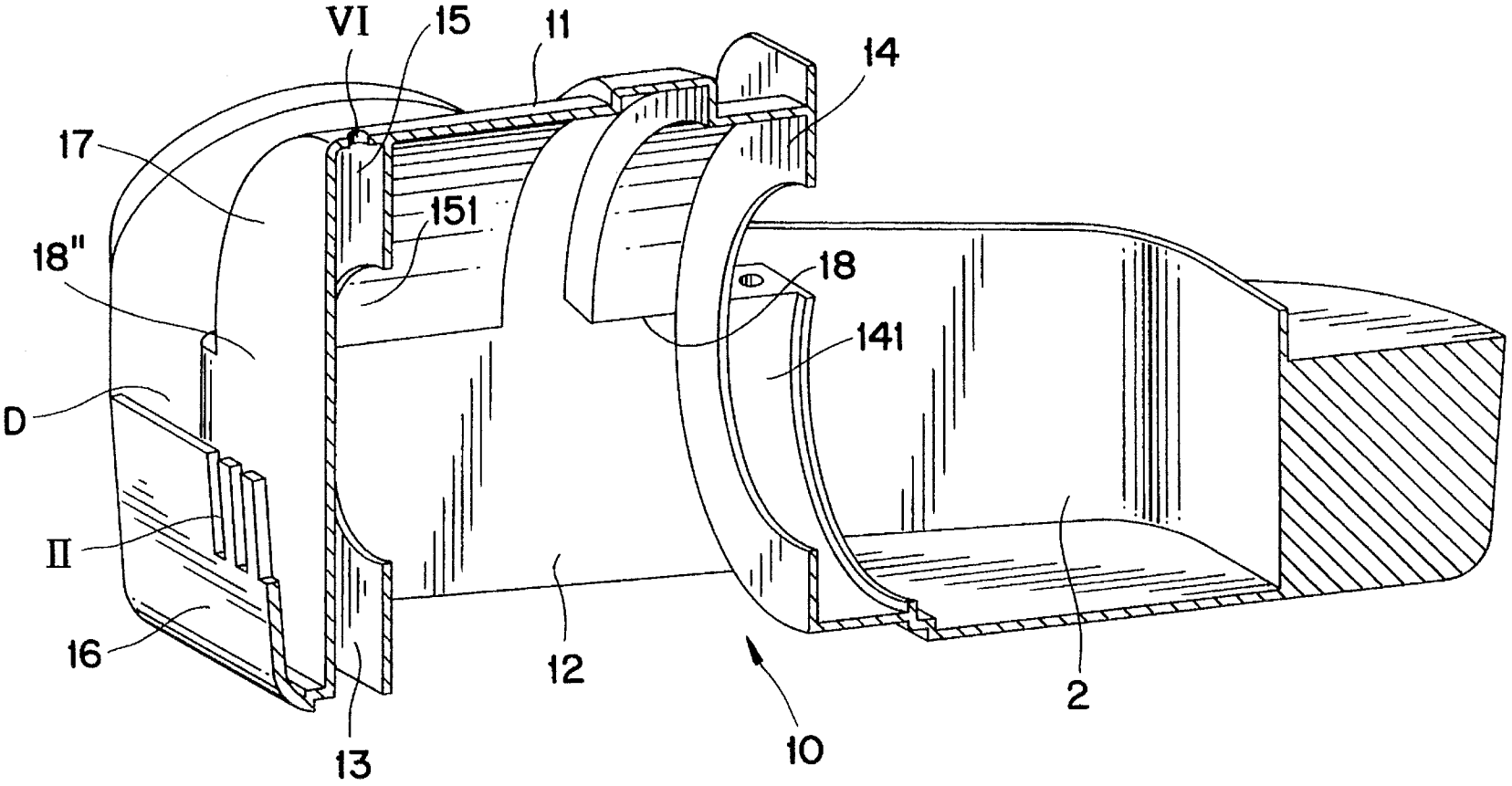
FIG. 5 is a partially broken perspective view of the lower case of FIG. 4.
Figure 6:
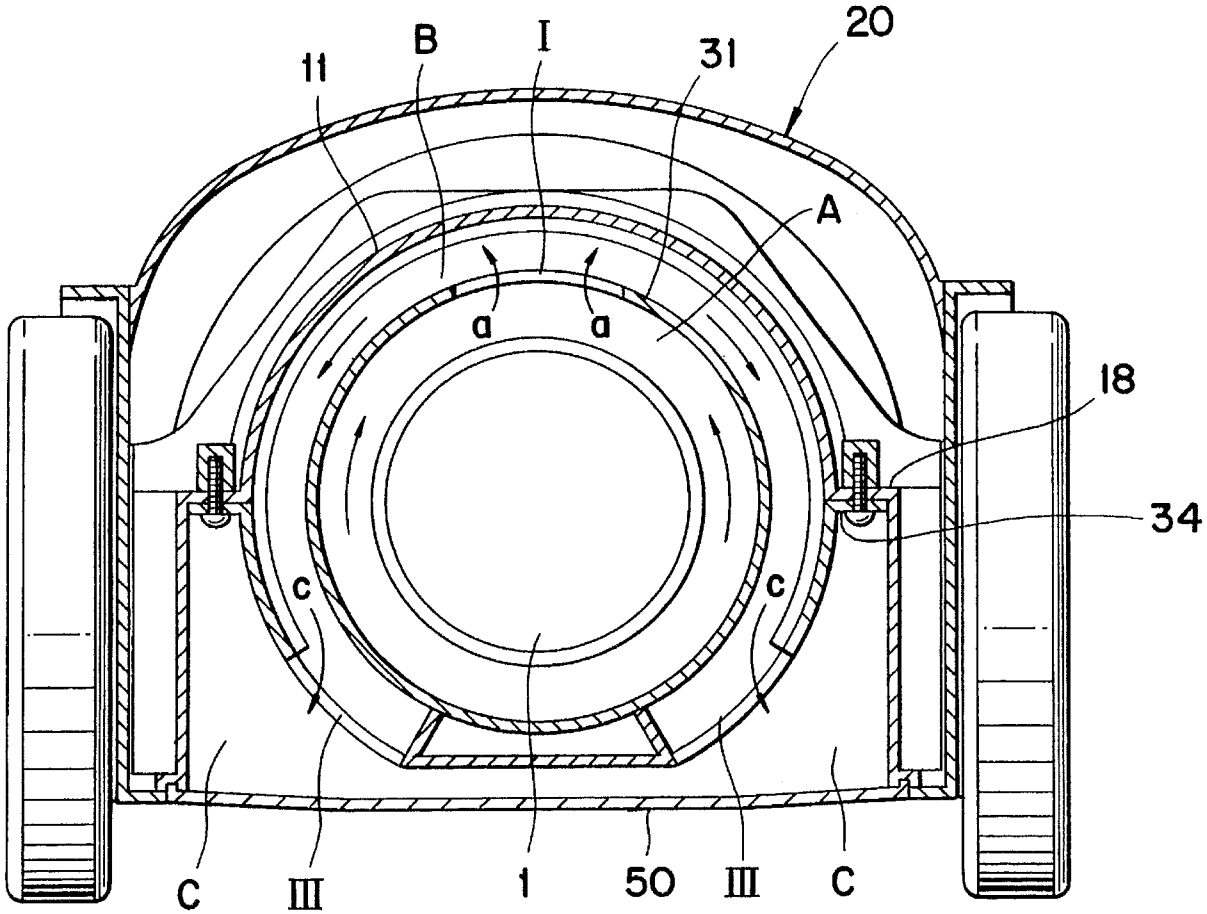
FIG. 6 is a sectional view of the rear section of the vacuum cleaner of FIG. 2, showing an exhaust air flow.

When the top case 20 is coupled to the lower case 10 after the lower case 10 is coupled to the bottom case 50, the assembling of the casing of the vacuum cleaner is finished. As a result of coupling the top case 20 to the lower case 20, the fourth and fifth exhaust channels or paths D (FIG. 2) and E (FIG. 3).

In the above vacuum cleaner, the noise of the exhaust air flow out of the suction motor 1 is repeatedly absorbed and suppressed by the noise absorbing and suppressing means comprising the first to fifth exhaust paths A to E which define a serpentine exhaust channel for the air.

The noise caused by the exhaust air flow out of the suction motor 1 is also dispersed by noise dispersing means, which dispersing means comprises the plurality of exhaust ports I, II, III, IV and VII and the plurality of exhaust ports V and VIII, the exhaust ports V and VIII being provided with their respective noise absorbing filters. With the noise dispersing by the dispersing means, the noise caused by the exhaust air flow from the suction motor 1 is effectively suppressed.

The noise suppressing effect of the above silencing device is doubled by the noise intercepting means. That is, with the noise intercepting means comprising the middle case 30, the lower case 10, the bottom case 50 and the top case 20, the operational noise caused by the suction motor 1 is not emitted to the outside but successfully intercepted.

The operational effect of the silencing device of the primary embodiment of this invention will be given hereinbelow.

When turning on a power switch (not shown), the dirt-laden air is sucked into the dirt collection chamber through a nozzle (not shown) and the suction pipe (not shown) by the suction force of the suction motor 1. In the dirt collection chamber equipped with a dirt collection bag, the dirt-laden air is filtered so as to be purified. The purified air is, thereafter, introduced into the suction motor 1 while the dirt remains in the dirt collection bag.

During operation of the suction motor 1, the motor 1 generates vibration which will cause vibrational noise. However, the vibration of the suction motor 1 is absorbed by the damping means 41, 42 so that the vibrational noise of the motor 1 is not emitted to the outside but suppressed.

The suction motor 1 also causes another noise or an operational noise such as caused by rotation of a rotor. However, this operational noise is preliminarily intercepted by the middle case 30 receiving the motor 1 therein and, thereafter, again intercepted by both the middle case receiving chamber 12 of the lower case 10 and the bottom case 50. The operational noise of the motor 1 is last intercepted by the top case 20.

That is, the operational noise of the suction motor 1 is repeatedly intercepted by the noise intercepting means, comprising the cases 10, 20, 30 and 50, thus to be successfully suppressed. In this regard, the operational noise of the motor 1 is not emitted to the outside.

In addition, the exhaust air flow out of the suction motor 1 generates an exhaust noise. However, this exhaust noise is absorbed and suppressed as the exhaust air flow passes in order through the exhaust paths A, B, C, D and E. The exhaust air flow is, thereafter, dispersed and discharged to the outside through the plurality of exhaust ports V and VIII of the lower case 10. In this regard, the exhaust noise of the vacuum cleaner is successfully suppressed and emitted to the outside as a lower level noise.

That is, the exhaust noise caused by the exhaust air from the suction motor 1 is absorbed and suppressed as the exhaust air flow passes through the noise absorbing and suppressing means comprising the exhaust paths A, B, C, D and E. The exhaust air flow is additionally dispersed and discharged to the outside through the noise dispersing means comprising exhaust ports V and VIII of the lower case 10. The exhaust noise of the vacuum cleaner is thus successfully suppressed and emitted to the outside as the lower level noise. Exhaust air from exhaust ports I and II of the middle case 30 travels through separate air travel passages to the air discharge ports VIII and V, respectively, as will be explained below.

If described in detail, the exhaust air flow out of the suction motor 1 passes through the first exhaust path A formed between the suction motor 1 and the cover part 31 of the middle case 30. Thereafter, the exhaust air flow is partly discharged to the outside of the middle case 30 through the exhaust port I of the cover part 31 of the middle case 30 as shown by the arrow "a". The other part of the exhaust air flow is discharged, as shown by the arrow "b", to the outside of the middle case 30 through the exhaust port II formed on the rear part 38 of the middle case 30.

The exhaust air flow discharged from the exhaust port I of the cover part 31 of the middle case 30 in turn passes through the second exhaust path B formed between the cover 11 of the lower case 10 and the cover part 31 of the middle case 30. The exhaust air flow is, thereafter, discharged from exhaust path B through the exhaust port III of the outer cover 35 of the middle case 30 as shown by the arrow "c" of FIG. 4. The exhaust air flow out of the exhaust port III of the outer cover 35 passes through the third exhaust path C (FIG. 6) formed between the outer cover 35 of the middle case 30 and the bottom case 50. This exhaust air flow is, thereafter, discharged from the exhaust port VII of the lower case 10 as shown by the arrow "d" of FIG. 3. The exhaust air flow out of the exhaust port VII of the lower case 10 passes through the fourth exhaust path E formed between the top case 20 and the lower case 10. This exhaust air flow is, thereafter, discharged from the lower case 10 through the exhaust port VIII of the lower case 10 as shown by the arrow "e" of FIG. 3.

Here, the exhaust port VIII of the lower case 10 is provided with noise absorbing filter so that the exhaust noise, which noise possibly remains in the exhaust air flow regardless of passing of the exhaust air flow through the exhaust paths A, B, C, E is last absorbed and suppressed as the exhaust air flow passes through exhaust port VIII.

Meanwhile, the exhaust noise caused by the exhaust air flow which has already passed through the suction motor 1, the first exhaust path A and the exhaust port II of the rear part 38 of the middle case 30 as shown at the arrow "b", is absorbed and suppressed in a path formed by the noise absorbing chamber 13 of the lower case 10. The exhaust air flow, thereafter, passes through the exhaust ports VI of the cover 11 of the lower case 10 as shown by the arrow "f". The exhaust air flow out of the exhaust ports VI passes through the exhaust path D formed between the partition wall 17 of the lower case 10 and the top case 20 and, thereafter, exhausts to the outside through the rear exhaust port V of the lower case 10, as shown by the arrow "g" of FIGS. 2 to 4.

The exhaust port V of the lower case 10 is provided with a noise absorbing filter in the same manner as described for the exhaust port VIII so that the exhaust noise, which noise possibly remains in the exhaust air flow regardless of passing of the exhaust air flow through the exhaust paths A and B and the noise absorbing chamber 13, is last absorbed and suppressed as the exhaust air flow passes through exhaust port V.

It will be appreciated that the path A is common to two serpentine exhaust channels, one of which being defined by paths A, B, C, and E, and the other defined by pats A, 13 and D.

In accordance with the silencing device of the above primary embodiment, the operational vibration of the suction motor 1 is absorbed by the damping means of the suction motor 1 so that the vibrational noise possibly caused by the vibration of the motor 1 is successively suppressed. The operational noise of the suction motor 1, which operational noise is caused by such as rotation of the rotor of the motor 1, is intercepted by the noise intercepting means and successfully suppressed in the casing of the vacuum cleaner. The exhaust noise caused by the exhaust air flow out of the suction motor 1 is absorbed and suppressed by both the noise absorbing and suppressing means and the noise dispersing means, thus to be suppressed and to become a lower level noise when emitted to the outside of the cleaner. With the above noise suppressing effect, the silencing device according to the primary embodiment of this invention gives pleasure to the user and improves the quality of the vacuum cleaner.

Figure 7:
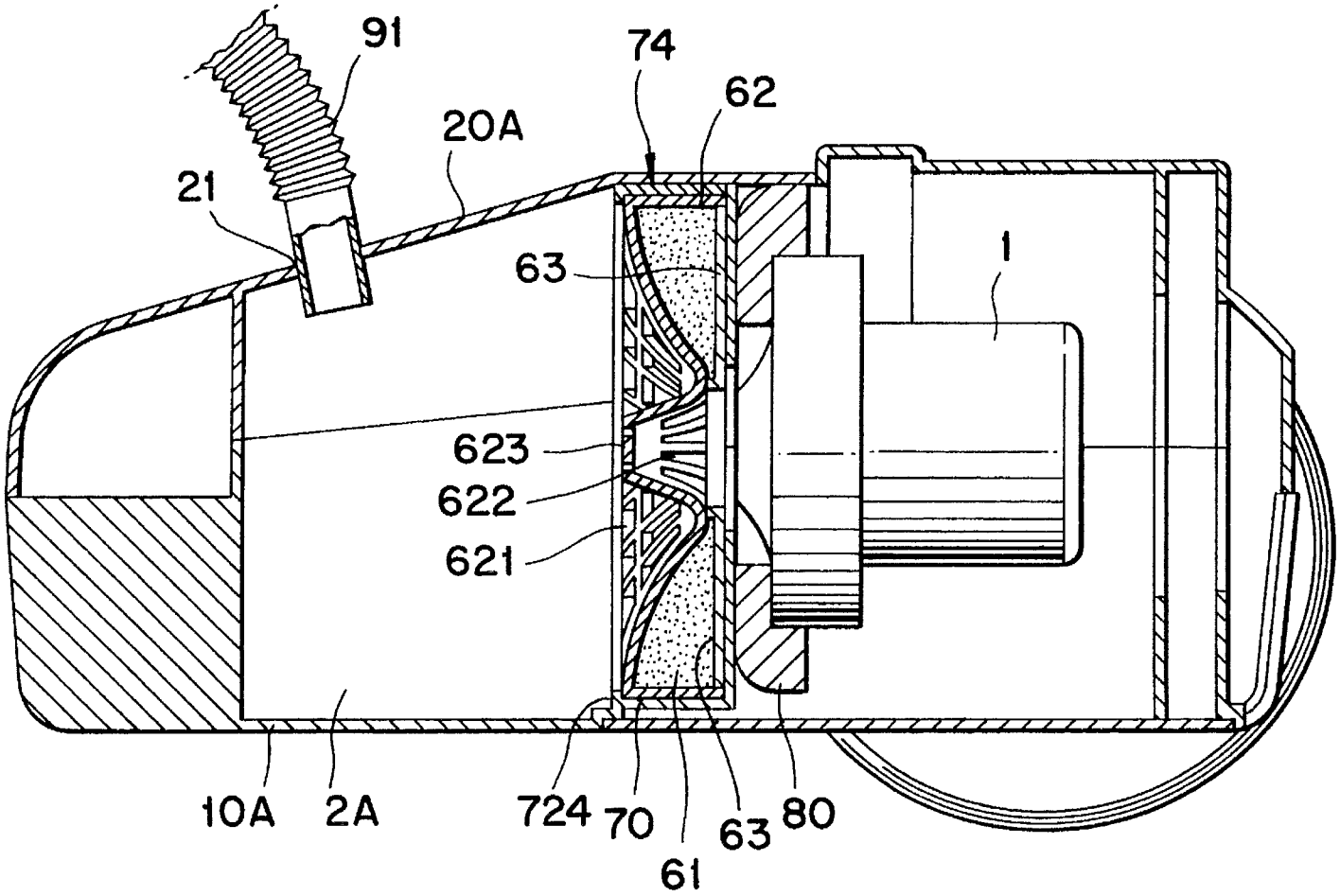
FIG. 7 is a schematic sectional view of a vacuum cleaner having a silencing device of a second embodiment of the present invention.
Figure 8:
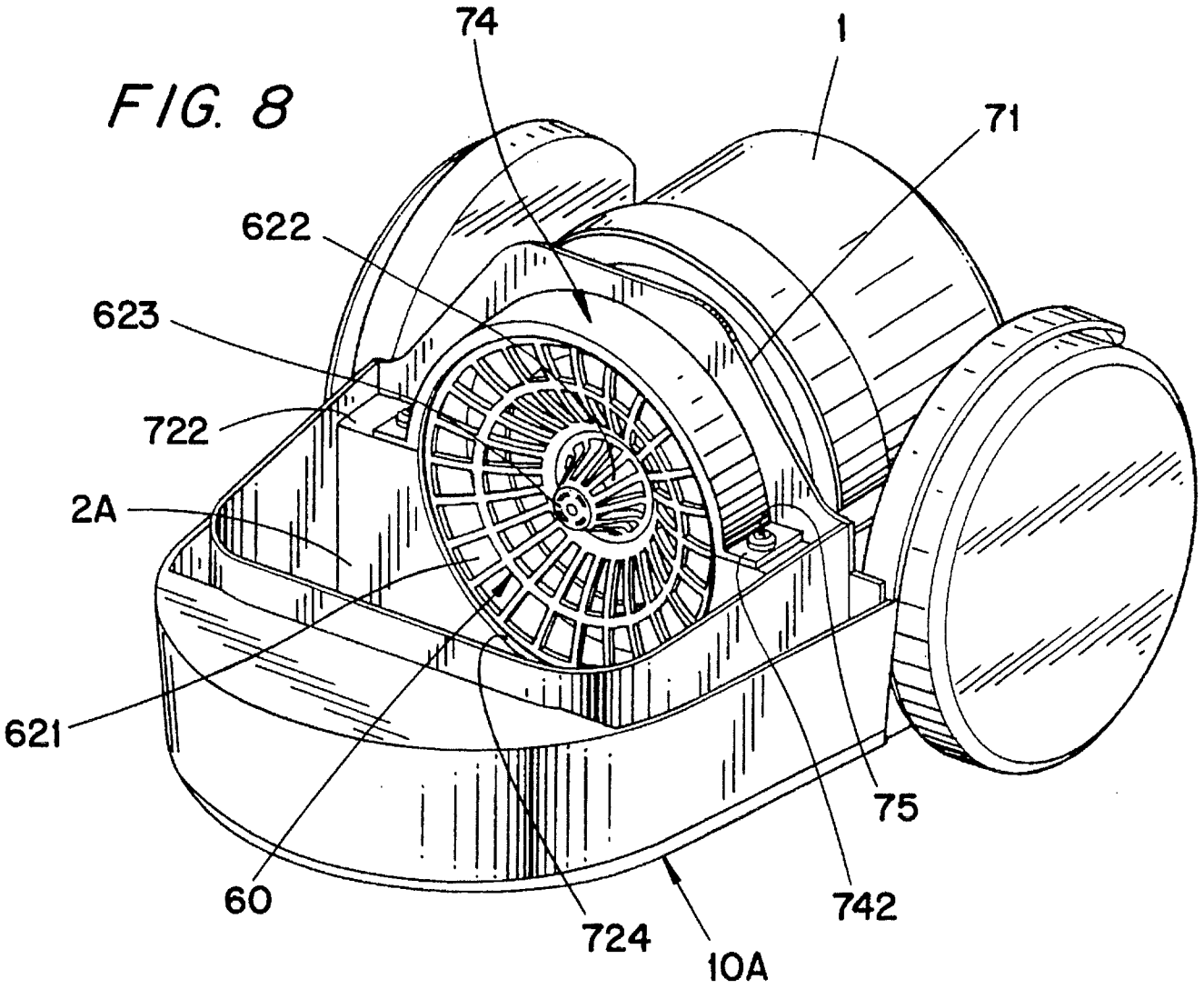
FIG. 8 is a perspective view of the vacuum cleaner of FIG. 7 free from a top case, showing a construction of the silencing device.
Figure 9:
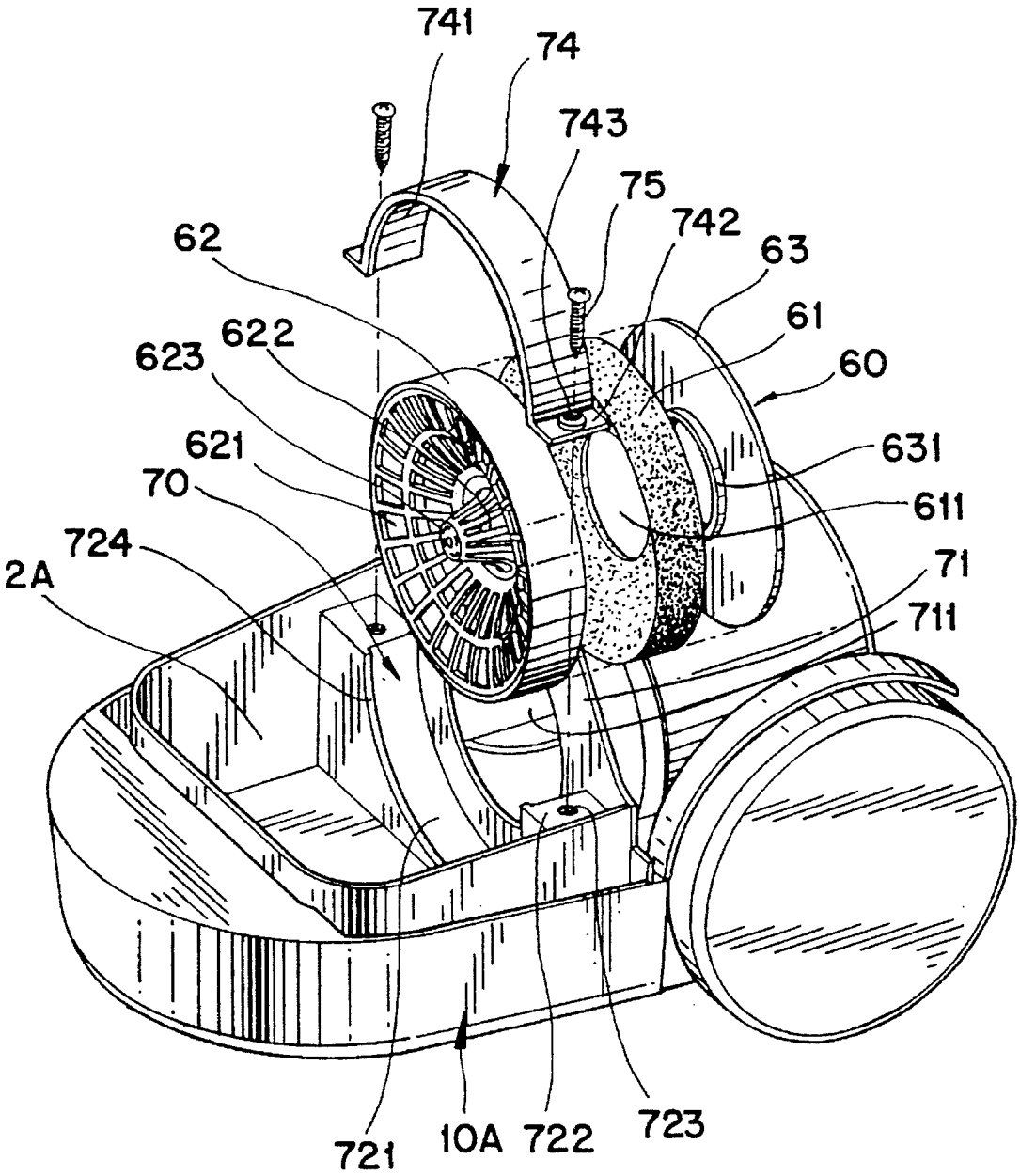
FIG. 9 is an exploded perspective view of the vacuum cleaner of FIG. 7, showing the silencing device.

Turning to FIGS. 7 to 9, there is shown a silencing device for a vacuum cleaner in accordance with a second embodiment of the present invention.

In FIGS. 7 to 9, the silencing means designated by the numeral 60 comprises a noise absorber 61, a cover 62 and an absorber supporter 63. The silencing means 60 absorbs and suppresses both the operational noise of the suction motor 1 as well as the suction noise caused by the suction air flow during operation of the suction motor 1.

The noise absorber 61 of the silencing means 60 is made of a noise absorbing material and provided with a suction port 611 (FIG. 9) at on its center for allowing suction of the dirt-laden air. The noise absorber 61 is gradually increased in its thickness in the direction from its center to its outer edge. The thickness variation of the noise absorber 61 is achieved by causing the front surface of the noise absorber 61 to be streamlined. This streamlined surface of the absorber 61 is best seen in the sectional view of FIG. 7. With the streamlined surface of the absorber 61, the noise suppressing effect of the absorber 61 is improved.

The cover 62 of the silencing means 60 covers the noise absorber 61 at the side of the streamlined surface of the absorber 61. In order to receive the noise absorber 61 and to meet with the streamlined surface of the absorber 61, the cover 62 opens in a rear direction and is shaped so as to correspond to the streamlined surface of the absorber 61. The cover 62 has a projection 623 extending forward from the center of streamlined wall of the cover 62.

The streamlined wall of the cover 62 is provided with a radial rib structure 621 for causing the noises caused by both the suction air flow and the suction motor to be absorbed and suppressed by the noise absorber 61. In order to prevent a vortex flow of the sucked air but to let much more air be sucked into the suction motor 1, a rib structure 622 comprising a plurality of ribs are formed on the side surface of the projection 623.

The absorber supporter 63 of the silencing means 60 is fitted into the opening of the cover 62, thus to support the noise absorber 61 placed in the cover 62. The absorber supporter 63 is opened at its center and provided with a boss 631 about its center opening, thus to prevent possible abrasion of the noise absorber 61 caused by the suction air flow.

In the drawings, the lower case 10A receives the suction motor 1 in its back. The lower case 10A also has, at its front section, a dirt collection chamber 2A having a dirt collection bag (not shown).

The lower case 10A is also provided at its middle section or at the front of the suction motor 1 with a support 70 for supporting the silencing means 60.

The support 70 of the lower case 10A includes a support surface 721, at which support surface 721 the support 70 comes into surface contact with the cover 62 of the silencing means 60 for supporting the means 60. A support flange 724 extends radially inwardly from the edge of the support surface 721 and retains the cover 62 in place. With the support flange 24, the cover 62 is prevented from being suddenly separated toward the dirt collection chamber 2. The support 70 also includes a pair of fixing surfaces 722 at opposite side ends. The fixing surfaces 722 having respective threaded holes 723 are coupled to opposite flanges 742 of an arcuate fixing member 74 by bolts 75, which fixing member 74 and bolts 75 will be described later herein. At the back of the support 70, a support ring 71 is integrally formed with the support 70 for supporting the absorber supporter 63 of the silencing means 60 as well as for supporting damping means 80, which damping means 80 will be described later herein. With the support ring 71, the absorber supporter 63 of the silencing means 60 is prevented from being suddenly separated toward the suction motor 1.

The center of the support ring 71 is opened so as to form a suction opening 711. The suction opening 711 of the support ring 71 allows the air, which air has already passed through both the rib structure 622 of the cover 62 and the suction port 611 of the noise absorber 61, to be sucked into the suction motor 1 therethrough.

The damping means 80 is placed between the support ring 71 and the suction motor 1 as shown in FIG. 7. The damping means 80 not only prevents possible leakage of sucked air but also absorbs the operational vibration of the suction motor 1.

The arcuate fixing member 74 tightens the cover 62 of the silencing means 60 so as to retain the silencing means 60 in place. This fixing member 74 includes an arcuate surface part 741 which comes into tight contact with the upper surface of the cover 62 for supporting the cover 62 in its place. The opposite flanges 742 of the fixing member 74 extend from the opposite ends of the arcuate surface part 741 and come into contact with the fixing surfaces 722 of the support 70 respectively. The opposite flanges 742 are also provided with their respective threaded holes 743 which correspond to the threaded holes 723 of the support 70.

When placing the silencing means 60, the means 60 is seated on the support 70 and, thereafter, tightened by the arcuate fixing member 74. At this time, the fixing member 74 is placed on the cover 62 of the means 60 in such a manner that the member 74 comes into surface contact with the upper surface of the cover 62. After placing the fixing member 74 on the cover 62, the opposite flanges 742 of the fixing member 74 are screwed to the fixing surfaces 722 of the support 70 by the bolts 75. When tightening the bolts 75 received in both the threaded holes 743 and 723, the silencing means 60 is tightly seated in place.

The lower case 10A is coupled to the top case 20A so as to form the dirt collection chamber 2A therebetween. In accordance with the present invention, it is preferred to let the cases 10A and 20A have attractive outer appearances since they form the outer appearance of the vacuum cleaner.

The top case 20A is provided with a pipe inlet 21 for detachably receiving a suction pipe 91, which pipe 91 connects the outer casing of the cleaner to a nozzle (not shown).

The outer casing of the vacuum cleaner comprises the lower case 10A and the top case 20A which are coupled to each other.

The operational effect of the silencing device of the second embodiment of this invention will be given hereinbelow.

When turning on a power switch (not shown), the dirt-laden air is sucked into the dirt collection chamber 2A through a nozzle (not shown) and the suction pipe 91 by the suction force of the suction motor 1. In the dirt collection chamber 2A equipped with a dirt collection bag (not shown), the dirt-laden air is filtered so as to be purified. The air is, thereafter, introduced into the suction motor 1 so as to be exhausted to the outside of the cleaner while the dirt remains in the dirt collection bag.

During operation of the suction motor 1, the motor 1 generates operation noise. However, the operational noise of the suction motor 1 is partly emitted to the dirt collection chamber 2A through the suction opening 711 of the support ring 71, the suction port 611 of the noise absorber 61 and the rib structure 622 of the cover 62. The operational noise is also reflected in the dirt collection chamber 2A and absorbed by the noise absorber 61 through the rib structure 621 of the cover 62 of the silencing means 60. The operational noise of the suction motor 1 is thus suppressed.

That is, the operational noise of the suction motor 1 emitted to the dirt collection chamber 2A is not emitted to the outside of the cleaner through the pipe 91 but absorbed by the noise absorber 61 of the silencing means 60, thus to be suppressed.

In operation of the vacuum cleaner, the dirt-laden air is sucked into the dirt collection chamber 2A through the nozzle and the suction pipe 91 by the suction force of the suction motor 1. In the dirt collection chamber 2A, the dirt-laden air is filtered so as to be purified. The air is, thereafter, introduced into the suction motor 1 so as to be exhausted to the outside of the cleaner while the dirt remains in the dirt collection bag.

At this time, the air sucked into the suction motor 1 is minimized in its frictional resistance and smoothly flows along the streamlined wall of the cover 62, thus to be introduced to the rib structure 622 of the projection 623 of the cover 62.

Here, since the air flows along the streamlined wall of the cover 62 so as to be introduced to the rib structure 622 of the projection 623 of the cover 62, it is minimized in its frictional resistance. In this case, a noise which is generated by the air flow is partly absorbed by the noise absorber 61 through the rib structure 621 of the cover 62, thus to be suppressed.

The noise of the air flow which is not still absorbed by the noise absorber 61 is reflected by the inner surface of the dirt collection chamber 2A and absorbed by the noise absorber 61 of the silencing means 60.

In the same manner as described for the operational noise of the suction motor 1, the suction noise caused by the suction air flow in the dirt collection chamber 2A is thus not emitted to the outside of the cleaner through the pipe 91 but absorbed by the noise absorber 61 of the silencing means 60, thus to be suppressed.

The cover 62 of the silencing means 60 has the center projection 623 having the rib structure 622. When large amount of air is introduced to the rib structure 622 of the front projection 623, there is generated no vortex in the rib structure 622 and this lets much more air be sucked to the suction motor 1.

As described above, the silencing device according to the above second embodiment absorbs, using a noise absorber of silencing means, both the operational noise of the suction motor and the suction noise caused by suction of dirt-laden air. In this regard, the noises of the vacuum cleaner is more effectively suppressed. With the above noise suppressing effect, the silencing device according to the second embodiment of this invention gives pleasure to the user and improves the quality of the vacuum cleaner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vacuum cleaner comprising:

a casing forming air inlet means and air outlet means;

a bag chamber formed in said casing for holding a dirt-collecting bag and communicating with said air inlet means for receiving dirt-laden air therefrom; a suction generator including a motor, mounted in said casing, for generating an air flow from said air inlet to said air outlet means; and a damping structure mounting said suction generator to said casing for damping motor vibration;

said air outlet means comprising at least one series of exhaust paths defining a serpentine air exhaust channel for absorbing noise;

said casing comprising a top case, a bottom case mounted to said top case, a lower case mounted between said top and lower cases, and a middle case disposed in said lower case, said motor disposed in said middle case.

2. The vacuum cleaner according to claim 1, wherein said at least one air exhaust means includes two series of serpentine exhaust paths defining respective exhaust channels which discharge air outside of said casing at separate locations on said casing.

3. The vacuum cleaner according to claim 2, wherein said casing forms a motor chamber in which said suction generator is disposed, a first of said exhaust paths being annular and formed around a circumference of said suction generator, said first exhaust path being common to both of said exhaust channels.

4. A vacuum cleaner comprising:

a casing forming an air inlet, a dirt collection chamber for collecting dirt and communicating with said air inlet, a generator chamber, and a plurality of final air discharge ports; and a suction generator mounted in said generator chamber for producing an air flow entering said air inlet, passing through said dirt collection chamber, exiting said generator chamber through a plurality of exhaust ports thereof, and discharging to ambient atmosphere through respective ones of said final air discharge ports;

said casing forming a first air travel passage extending from one of said exhaust ports to one of said final air discharge ports, and a second air travel passage extending from another of said exhaust ports to another of said final air discharge ports, said first and second air travel passages being separate from one another.

5. The vacuum cleaner according to claim 4, wherein each of said final air discharge ports contains a noise absorbing filter.

6. The vacuum cleaner according to claim 4, wherein said casing comprises a top case mounted on a bottom case, a lower case disposed between said top and bottom cases, and a middle case disposed in said lower case, said middle case forming said generator chamber and containing said plurality of exhaust ports.

7. The vacuum cleaner according to claim 4, wherein said casing includes an outer case structure and a middle case disposed in said outer case structure, said suction generator disposed in said middle case and spaced therefrom to form therebetween an air travel path leading from said suction generator to said plurality of exhaust ports.

8. The vacuum cleaner according to claim 7, wherein said casing further includes a lower case disposed in said outer case structure, said middle case disposed in said lower case, a portion of said middle case spaced from said lower case to form therewith a portion of one of said air travel passages.

9. The vacuum cleaner according to claim 8, wherein a portion of said lower case is spaced from a bottom portion of said outer case structure to form therewith another portion of said one air travel passage.

10. The vacuum cleaner according to claim 9, wherein a portion of said lower case is spaced from a top portion of said outer case structure to form therewith another portion of said one air travel passage.

* * * * *